US009918532B2

(12) United States Patent
Bloom et al.

(10) Patent No.: US 9,918,532 B2
(45) Date of Patent: Mar. 20, 2018

(54) INTERCHANGEABLE LUGGAGE PERIMETER

(71) Applicant: Contrail, LLC, Bellevue, WA (US)

(72) Inventors: Ronald Lawrence Bloom, Bellevue, WA (US); John Spencer Bandringa, Everett, WA (US)

(73) Assignee: CONTRAIL, LLC, Bellevue, WA (US)

( * ) Notice: Subject to any disclaimer, the term of this patent is extended or adjusted under 35 U.S.C. 154(b) by 272 days.

(21) Appl. No.: 14/879,353

(22) Filed: Oct. 9, 2015

(65) Prior Publication Data

US 2016/0100658 A1 Apr. 14, 2016

Related U.S. Application Data

(60) Provisional application No. 62/062,236, filed on Oct. 10, 2014.

(51) Int. Cl.
*A45C 5/14* (2006.01)
*A45C 13/26* (2006.01)
*A45C 13/36* (2006.01)

(52) U.S. Cl.
CPC ..... *A45C 5/143* (2013.01); *A45C 13/26* (2013.01); *A45C 13/36* (2013.01)

(58) Field of Classification Search
CPC ..... A45C 5/143; A45C 13/26; A45C 13/36
See application file for complete search history.

(56) References Cited

U.S. PATENT DOCUMENTS

| | | | | |
|---|---|---|---|---|
| 47,114 | A * | 4/1865 | Lieb et al. | B60B 33/0028 16/45 |
| 3,935,613 | A * | 2/1976 | Kaneko | A45C 5/143 16/30 |
| 4,418,804 | A * | 12/1983 | Bradley | A45C 3/001 190/127 |
| 5,365,635 | A * | 11/1994 | Jang | A45C 5/145 16/34 |
| 5,815,885 | A * | 10/1998 | Chen | A45C 5/14 16/18 B |
| 6,167,994 | B1 * | 1/2001 | Kuo | A45C 5/14 190/18 A |
| 6,193,324 | B1 * | 2/2001 | Chang | A45C 5/14 190/18 A |
| 2003/0006110 | A1 * | 1/2003 | Lin | A45C 5/14 190/18 A |

* cited by examiner

*Primary Examiner* — Tri Mai
(74) *Attorney, Agent, or Firm* — Nathaniel A. Gilder; Jensen & Puntigam, PS

(57) ABSTRACT

Interchangeable luggage perimeters are disclosed. Example interchangeable luggage perimeters may comprise an interchangeable base element adapted to securely and releasably couple with exchangeable components such as exchangeable foot pads, exchangeable wheels, or exchangeable handles. The interchangeable base element may be interchangeable by having a configuration supporting repositioning of the interchangeable base element at multiple different edges of a luggage piece, e.g., any of at least two or four edges of a luggage piece.

6 Claims, 5 Drawing Sheets

INTERCHANGEABLE LUGGAGE PERIMETER

CROSS-REFERENCE TO RELATED APPLICATIONS

The present application is a nonprovisional claiming priority under 35 U.S.C. § 119 of U.S. Provisional Application 62/062,236, entitled "Interchangeable Luggage Perimeter", filed on Oct. 10, 2014, the entire contents of which are incorporated herein by reference.

BACKGROUND

Today's typical luggage piece may generally include a rigid rectangular frame with a tough fabric or other sturdy material surrounding the frame. Luggage piece dimensions may be, e.g. 15 centimeters (cm) to 1.5 meters (m) along any edge. One side face of a luggage piece may include a door, which may open and close and may be secured shut by a zipper, snaps, clips, or other releasable fasteners. In some examples, two wheels may be positioned at one edge, and a handle may extend from an opposite edge, allowing a luggage piece to be wheeled from place to place. In other examples a luggage piece may have one or more handles to carry the luggage piece, and no wheels. A wide variety of additional features may be included in today's luggage as will be appreciated.

Luggage is preferably designed with sufficient durability to withstand the stress of loading and unloading the luggage from vehicles such as cars and airplanes, as well as carrying or otherwise moving the luggage from place to place including, e.g., up and down stairs. However, making luggage which is lightweight while also sufficiently durable is a challenge, and today's luggage often wears out or sustains damage. Therefore ongoing improvements in luggage design and durability are needed.

SUMMARY

The present disclosure generally describes interchangeable luggage perimeters. Some example interchangeable luggage perimeters may comprise an interchangeable base element adapted to securely and releasably couple with exchangeable components such as exchangeable foot pads, exchangeable wheels, and/or exchangeable handles.

The interchangeable base element may be interchangeable, e.g., by having a configuration supporting repositioning of the interchangeable base element at multiple different edges of a luggage piece. For example, in a symmetrical configuration, the interchangeable base element may be repositioned to any of at least four edges of a luggage piece. In an asymmetrical configuration, the interchangeable base element may be repositioned to any of at least two edges of a luggage piece.

The interchangeable base element may comprise a base element outer surface and a base element inner surface, wherein the base element outer surface and the base element inner surface comprise parallel surfaces each having substantially a base element width and substantially a base element length. The base element outer surface and the base element inner surface may be separated by a base element thickness. The interchangeable base element may comprise, e.g., a thin rectangular shape in which the base element width is less than the base element length, and wherein the base element thickness is less than half of the base element width.

The interchangeable base element may comprise at least two fastener openings perpendicular to the base element outer surface and the base element inner surface. The at least two fastener openings may be positioned at substantially opposite ends of the base element length. In some embodiments, the interchangeable base element may be symmetrical about a center axis parallel to the base element width at one half of the base element length, so that the interchangeable base element may be affixed by fasteners through the at least two fastener openings to multiple different edges of a luggage piece, e.g., to any of at least four edges of a luggage piece. In some embodiments, the interchangeable base element may be asymmetrical about a center axis parallel to the base element width, so that the interchangeable base element may be affixed by fasteners through the at least two fastener openings to, e.g., any of at least two edges of a luggage piece.

The interchangeable base element may comprise an exchangeable component interface positioned between the at least two fastener openings and adapted to securely and releasably couple with exchangeable components. The exchangeable component interface may comprise, e.g., a shaped depression in the base element outer surface, wherein the shaped depression has shape adapted to match an exchangeable component shape, and at least one interface releasable coupling means adapted to releasably couple with component releasable coupling means on the exchangeable components.

The one or more exchangeable components may be adapted to securely and releasably couple with the exchangeable component interface of the interchangeable base element. For example, the one or more exchangeable components may comprise a shape adapted to match the shaped depression at the interchangeable base element, and component releasable coupling means adapted to releasably couple with the interface releasable coupling means at the interchangeable base element. As noted above, the one or more exchangeable components may include, for example, exchangeable foot pads, exchangeable wheels, and/or exchangeable handles. Further aspects, embodiments, and features will become apparent by reference to the drawings and the following detailed description.

DETAILED DESCRIPTION

In the following detailed description, reference is made to the accompanying drawings, wherein similar symbols typically identify similar components, unless context dictates otherwise. The illustrative embodiments described this description and drawings are not meant to be limiting. Other embodiments may be utilized, and changes may be made without departing from the spirit or scope of the subject matter presented here. It will be readily understood that the aspects of the present disclosure may be arranged, substituted, combined, and designed in a wide variety of different configurations, all of which are contemplated as part of this disclosure.

The present disclosure is generally drawn to interchangeable luggage perimeters. Some example interchangeable luggage perimeters may comprise an interchangeable base element adapted to securely and releasably couple with exchangeable components such as exchangeable foot pads, exchangeable wheels, or exchangeable handles. The interchangeable base element may be interchangeable by having a configuration supporting repositioning of the interchangeable base element at multiple different edges of a luggage piece, e.g., at any of at least two or four edges of a luggage piece.

Figure 1:
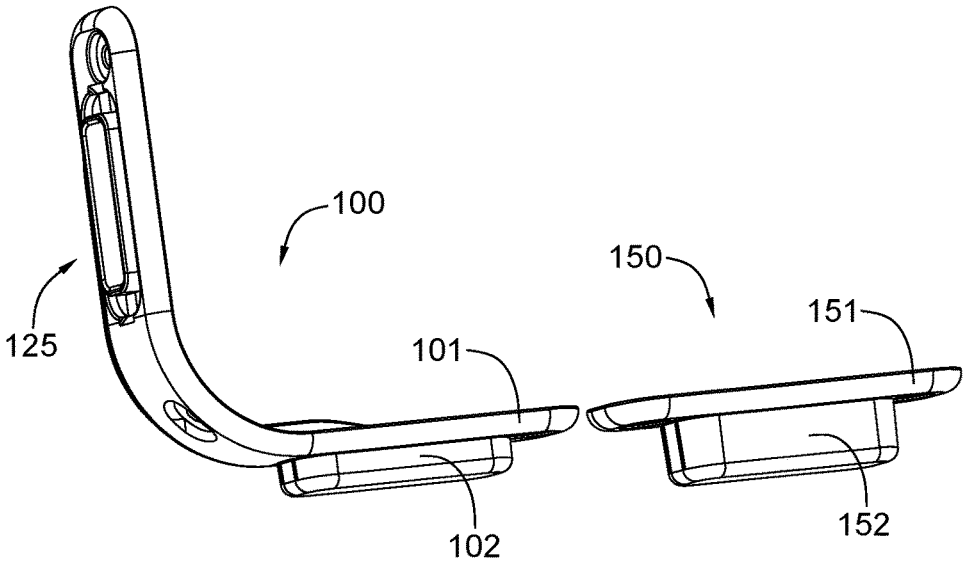
FIG. 1 illustrates two example interchangeable luggage perimeters, a corner element and a mid-edge element.

FIG. 1 illustrates two example interchangeable luggage perimeters, a corner element 100 and a mid-edge element 150. The corner element 100 includes an interchangeable base element 101 adapted to securely and releasably couple with exchangeable components such as exchangeable foot pad 102. Other exchangeable components, such as differently configured foot pads, exchangeable wheels, and/or exchangeable handles may optionally be coupled with interchangeable base element 101 in place of exchangeable foot pad 102. Interchangeable base element 101 may comprise one or more exchangeable component interfaces 125 adapted to securely and releasably couple with the exchangeable components.

Figure 10:
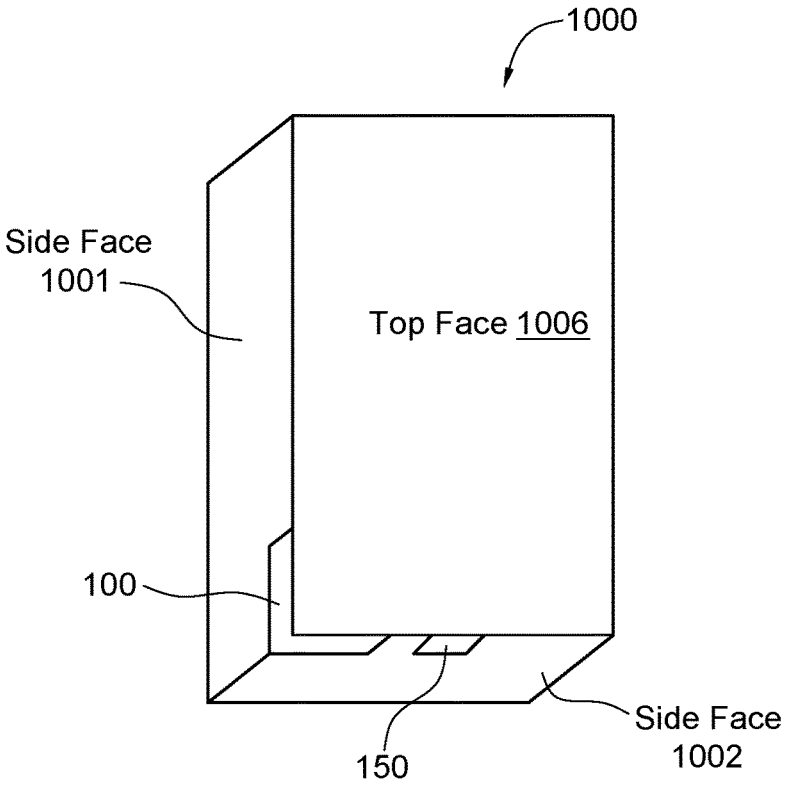
FIG. 10 illustrates a luggage piece fitted with interchangeable luggage perimeters.

The illustrated interchangeable base element 101 may be interchangeable by having a symmetrical configuration supporting repositioning of the interchangeable base element 101 at multiple different edges of a luggage piece, e.g., at any of at least four edges of a luggage piece and extending around any corner of the luggage piece, as discussed further with reference to FIG. 10.

The mid-edge element 150 includes an interchangeable base element 151 adapted to securely and releasably couple with exchangeable components such as exchangeable foot pad 152. Other exchangeable components, such as differently configured foot pads, exchangeable wheels, and/or exchangeable handles may be coupled with interchangeable base element 151 in place of exchangeable foot pad 152. The illustrated interchangeable base element 151 may be interchangeable by having a symmetrical configuration supporting repositioning of the interchangeable base element 151 at multiple different edges of a luggage piece, e.g., at any of at least four edges of the luggage piece, as discussed further with reference to FIG. 10.

The interchangeable base elements 101, 151 and exchangeable components 1-2, 152 may optionally be made from sturdy materials, such as hard plastics, nylon, rubber, metal, wood, or combinations of such materials. Those of skill in the art will appreciate that a wide variety of materials are available for making the structures described herein, any of which may be suitable for particular embodiments.

Figure 2:
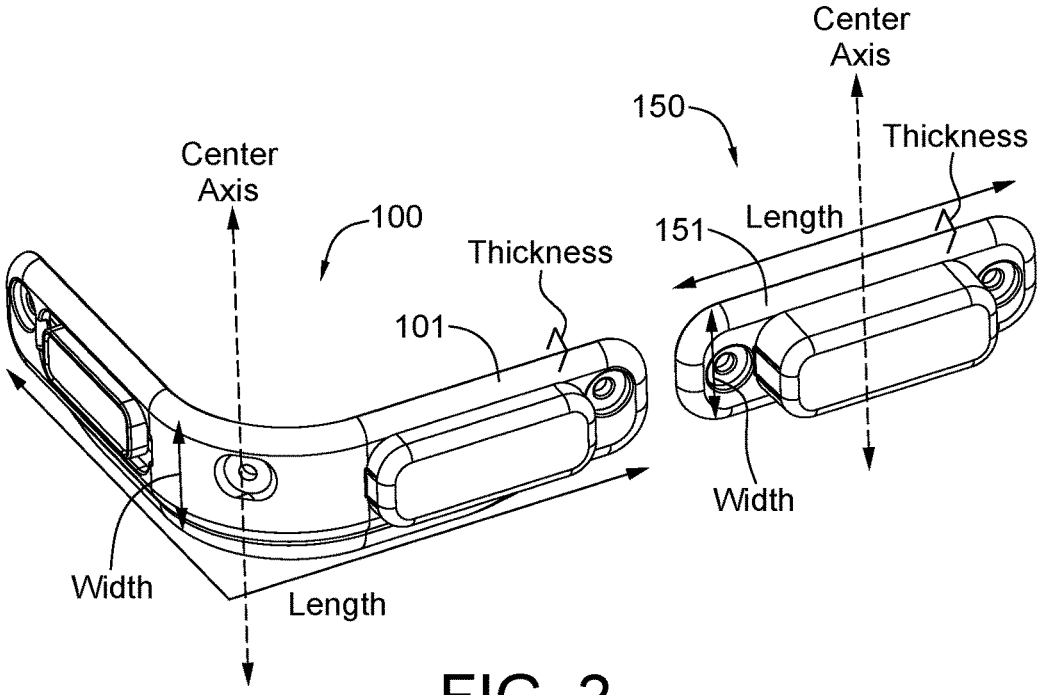
FIG. 2 illustrates another view of the two example interchangeable luggage perimeters from FIG. 1.

FIG. 2 illustrates another view of the two example interchangeable luggage perimeters 100, 150 from FIG. 1. The illustrated interchangeable base elements 101, 151 each individually comprise a base element outer surface and a base element inner surface, wherein the base element outer surface and the base element inner surface comprise generally parallel surfaces each having substantially a base element width and substantially a base element length. The surfaces of base elements 101, 151 shown in FIG. 2 are the base element outer surfaces; the base element inner surfaces are shown for example in FIG. 5. The base element outer surface and the base element inner surface may be separated by a base element thickness. In the case of the corner element 100, the base element 101 outer surface and the base element 101 inner surface bend to form two legs extending perpendicularly from one another, so that the corner element 100 may extend around a corner of a luggage piece.

The interchangeable base elements 101 and 151 may each comprise, e.g., a thin rectangular shape in which the base element width is less than the base element length, e.g., as shown in FIG. 2, and wherein the base element thickness is less than half of the base element width. For example, dimensions of the base element 101 may be, e.g., about 20 cm length (wherein each leg may be about 10 cm), about 2 cm width, and about 3 mm thickness. Thus the width may be approximately one tenth of the length, and the thickness may be approximately one tenth of the width. Example dimensions of the mid-edge base element 151 may be, e.g., about 8 cm length, about 2 cm width, and about 3 mm thickness. Thus the width may be approximately one fourth of the length, and the thickness may be approximately one tenth of the width. More generally, example dimensions of the base element 101 may be, e.g., about 10-30 cm length, about 1-4 cm width, and about 1-6 mm thickness. Example dimensions of the mid-edge base element 151 may be, e.g., about 4-12 cm length, about 1-4 cm width, and about 1-6 mm thickness.

In the case of the corner element 100, the rectangular shape of base element 101 may be curved or otherwise bent to form a corner and legs extending away from one another at substantially a right angle. The example length dimensions referred to herein include the combined lengths of both legs, in other words, the entire length of the corner element 100 if the corner element were to be straightened.

Figure 5:
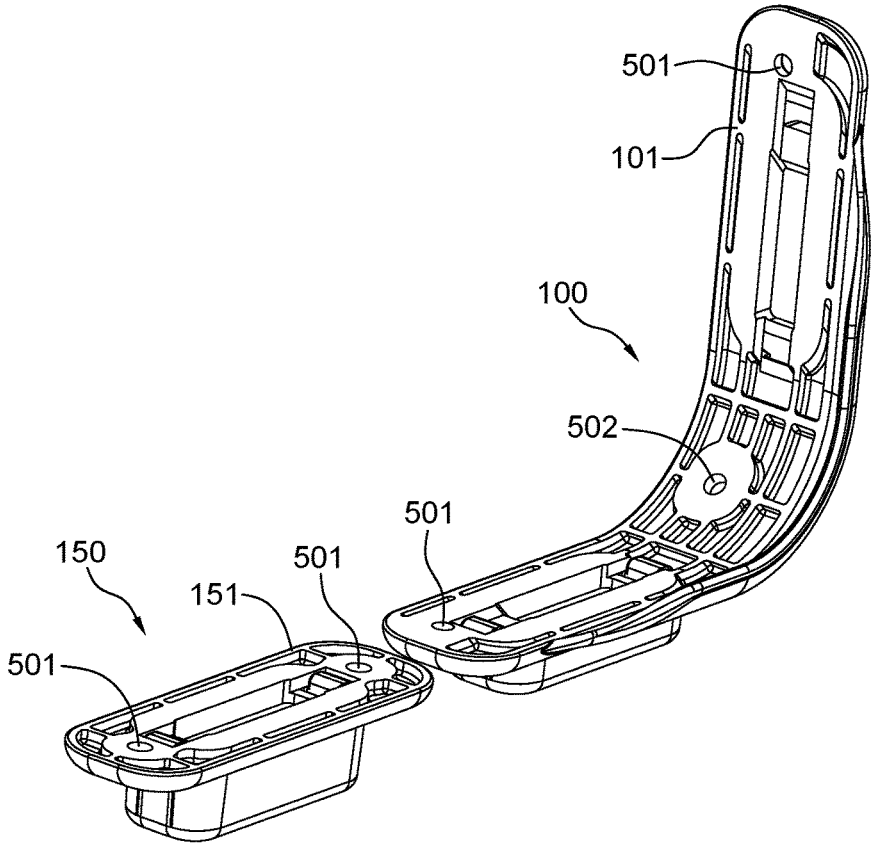
FIG. 5 illustrates another view of the two example interchangeable luggage perimeters from FIG. 1.

Interchangeable base elements 101 and 151 may each comprise at least two fastener openings 501, indicated for example in FIG. 5. Each of the at least two fastener openings 501 may be perpendicular to the base element outer surface and the base element inner surface. The at least two fastener openings 501 may be positioned at substantially opposite ends of the base element length.

For the corner element 100, the at least two fastener openings 501 may be supplemented by at least one third fastener opening 502 perpendicular to the base element outer surface and the base element inner surface, wherein the at least one third fastener opening 502 may be positioned substantially midway between the at least two fastener openings 501 at the ends. The third fastener opening 502 may be bisected by the corner element's center axis as illustrated in FIG. 2.

In some embodiments, the at least two fastener openings 501 and/or the third fastener opening 502 may be positioned in an offset manner, proximal to one side of the corner element 100, rather than centered in the middle of the corner element 100 width, as shown in FIG. 2. In other embodiments, the at least two fastener openings 501 and/or the third fastener opening 502 may be centered in the middle of the corner element 100 width.

Fastener openings 501, 502 may comprise openings adapted for any type of fastener, including, e.g., screws, nails, bolts, clips, rivets, and the like. Some embodiments may comprise a depression surrounding the fastener openings 501, 502 on the outer surface, so that fasteners may sit substantially flush with the outer surface. Some embodiments may omit fastener openings 501, 502 and may instead use fasteners that may be integrated into interchangeable base elements 101, 151, such as threaded studs or other structures extending from interior surfaces of interchangeable base elements 101, 151. Some embodiments may omit fastener openings 501, 502 and may instead be affixed to luggage using glue and/or thread or cord which sews interchangeable base elements 101, 151 to the luggage piece.

In some embodiments, interchangeable base elements 101 and 151 may each be symmetrical about a center axis parallel to the base element width at one half of the base element length, as illustrated in FIG. 2, so that the interchangeable base elements 101 and 151 may be affixed by fasteners through the at least two fastener openings to any of at least four edges of a luggage piece. When a first leg of the corner element 100 is affixed to any of the at least four edges of the luggage piece, a second leg of the corner element 100 extends around a corner and along an adjacent edge of the luggage piece, e.g., as illustrated in FIG. 10.

Figure 3:
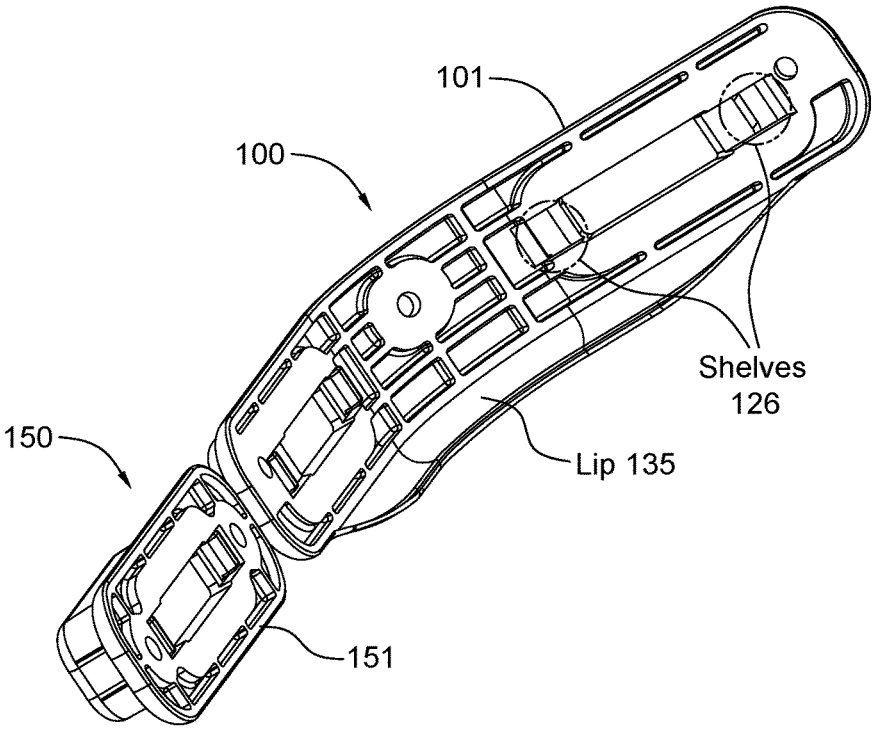
FIG. 3 illustrates another view of the two example interchangeable luggage perimeters from FIG. 1.

FIG. 3 illustrates another view of the two example interchangeable luggage perimeters 100, 150 from FIG. 1, including interchangeable base elements 101, 151. In some embodiments, corner element 100 may comprise a protective lip 135 and/or shelves 126. Lip 135 may be adapted to protect a corner bead extending about a luggage piece. In some embodiments, lip 135 may comprise a contoured corner bead protective lip extending from a single side of the base element 101. In some embodiments, mid-edge element 150 may include a side bead protective lip, similar to lip 135, as well as shelves similar to shelves 126. Shelves 126 may be adapted to releasably couple with component releasable coupling means on the exchangeable components 102 and 152, as illustrated in FIG. 1, and as explained in further detail herein.

Figure 4:
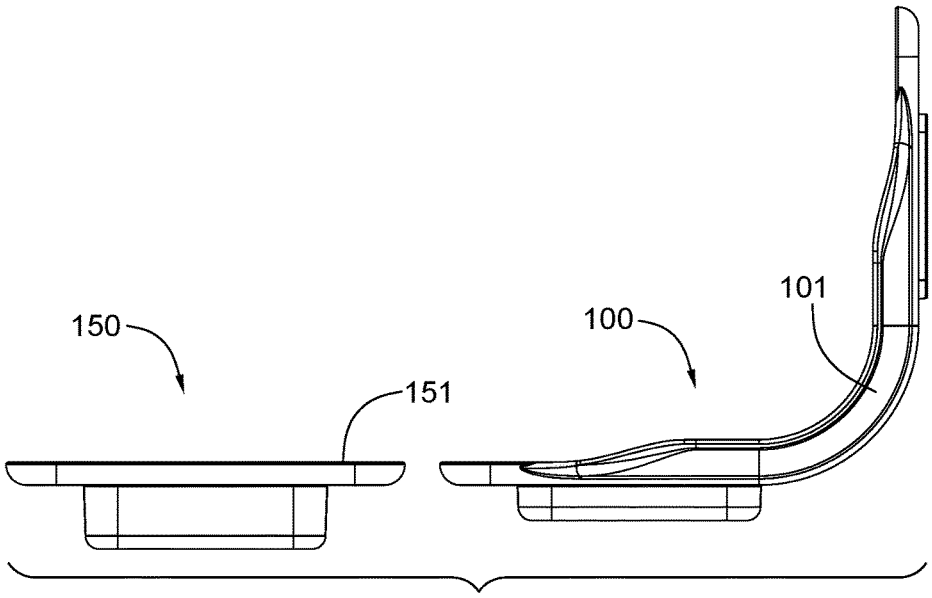
FIG. 4 illustrates another view of the two example interchangeable luggage perimeters from FIG. 1.

FIG. 4 illustrates another view of the two example interchangeable luggage perimeters 100, 150 from FIG. 1, including interchangeable base elements 101, 151. FIG. 4 illustrates a view of interchangeable base elements 101, 151 from a side opposite to the side illustrated in FIG. 1.

FIG. 5 illustrates another view of the two example interchangeable luggage perimeters 100, 150 from FIG. 1, including interchangeable base elements 101, 151. FIG. 5 provides a perspective view of the inner surfaces of base elements 101, 151. The at least two fastener openings 501 and the at least one third fastener opening 502 are indicated in FIG. 5.

Figure 6:
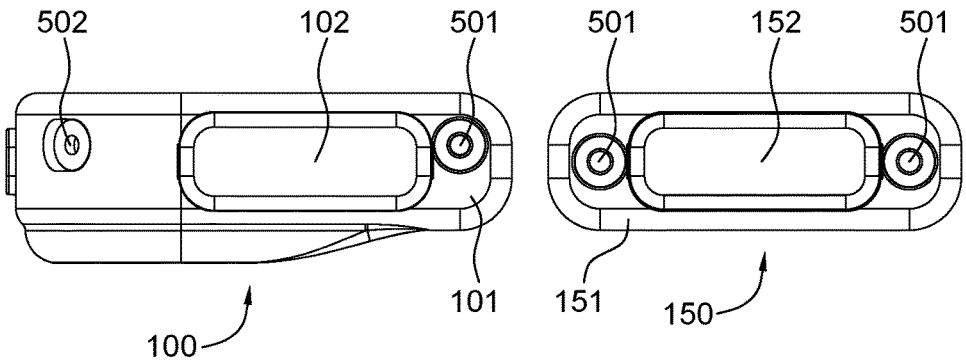
FIG. 6 illustrates another view of the two example interchangeable luggage perimeters from FIG. 1.

FIG. 6 illustrates another view of the two example interchangeable luggage perimeters 100, 150 from FIG. 1, including interchangeable base elements 101, 151. FIG. 6 provides a direct view of the base elements 101, 151, with exchangeable components in the form of exchangeable foot pads 102, 152 attached at exchangeable component interfaces 125 of the interchangeable base elements 101, 151 (exchangeable component interfaces 125 not visible in FIG. 6). FIG. 6 also shows various fastener openings 501 and fastener opening 502, as seen in the outer surfaces of base elements 101, 151.

Figure 7:
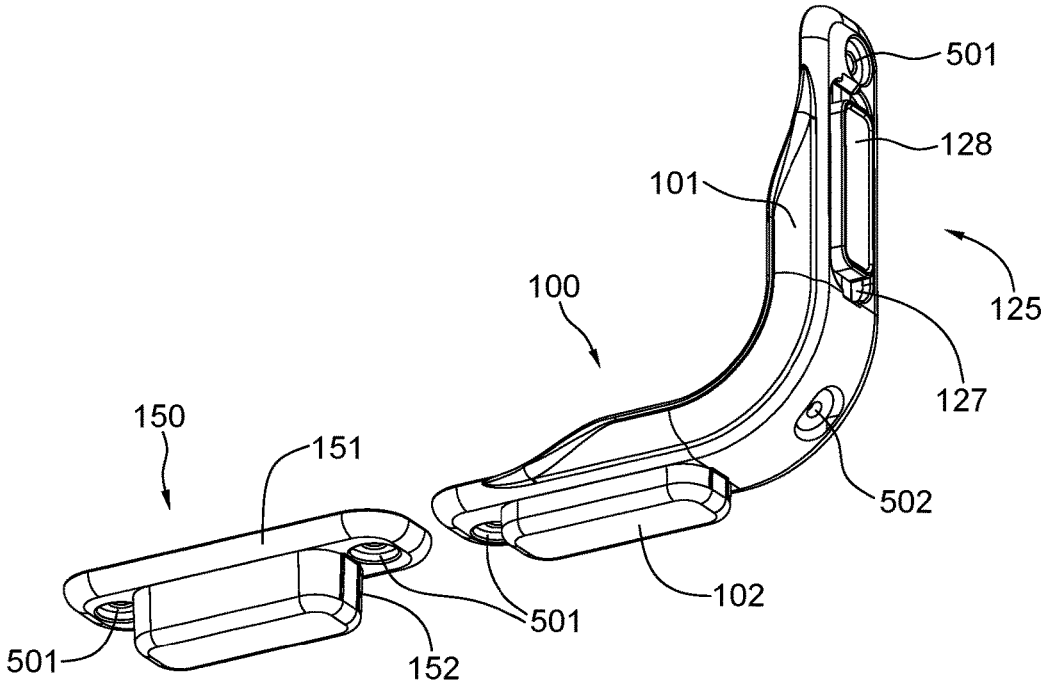
FIG. 7 illustrates another view of the two example interchangeable luggage perimeters from FIG. 1.

FIG. 7 illustrates another view of the two example interchangeable luggage perimeters 100, 150 from FIG. 1, including interchangeable base elements 101, 151. FIG. 7 illustrates an example exchangeable component interface 125, such as may couple with exchangeable foot pads 102, 152 or other exchangeable components. Interchangeable base elements 101 and 151 may each comprise exchangeable component interfaces, such as exchangeable component interface 125, positioned between the at least two fastener openings 501 of each interchangeable base element 101, 151, and adapted to securely and releasably couple with exchangeable components such as exchangeable foot pad 102 and exchangeable foot pad 152. The corner element 100 may comprise a first exchangeable component interface 125 positioned between the at least one third fastener opening 502 and a first of the at least two fastener openings 501, and a second exchangeable component interface 125 positioned between the at least one third fastener opening 502 and a second of the at least two fastener openings 501. In other words, there may be a second exchangeable component interface 125 under exchangeable foot pad 102 illustrated in FIG. 7. There may also be an exchangeable component interface 125 under exchangeable foot pad 152 illustrated in FIG. 7.

Figure 8:
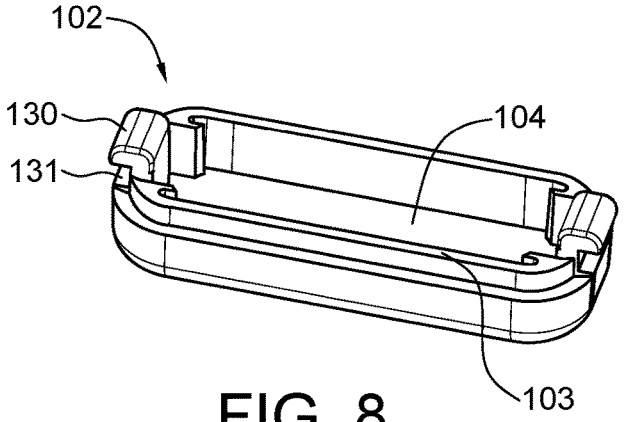
FIG. 8 illustrates an example exchangeable component.
Figure 9:
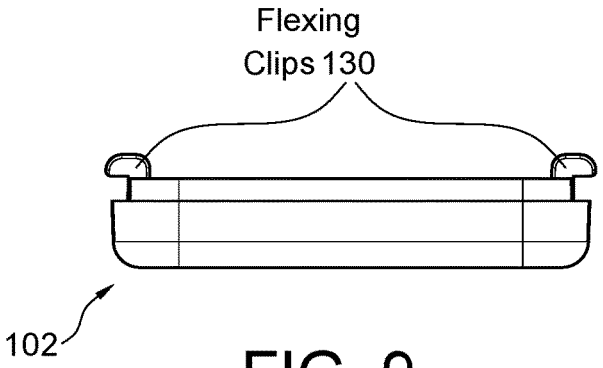
FIG. 9 illustrates another view of the example exchangeable component from FIG. 8.

FIG. 8 illustrates an example exchangeable component, including an example interface adapted to couple with exchangeable component interfaces 125 at base elements 101, 151. FIG. 8 includes an exchangeable component 102, comprising a ridge 103, a center depression 104, and flexing clips 130. Exchangeable component interfaces 125 at base elements 101, 151, such as illustrated in FIG. 7, may be adapted to couple with interfaces at exchangeable components, such as illustrated in FIG. 8. FIG. 9 provides another view of the example exchangeable component 102, which more clearly shows flexing clips 130 as an example of component releasable coupling means adapted to releasably couple with exchangeable component interfaces 125.

With reference to FIGS. 7 and 8, exchangeable component interfaces 125 may comprise, e.g., a shaped depression 127 in the base element outer surface. The shaped depression 127 may have a shape adapted to match an exchangeable component shape, that is, the shape of the exchangeable components 102 and 152, or portion thereof, such as a shape of the ridge 103 on exchangeable component 102 illustrated in FIG. 8. In some embodiments, the shaped depression 127 may comprise a substantially rectangular groove extending around a center island 128, as illustrated in FIG. 7. The center island 128 may be adapted to match the center depression 104 at the exchangeable components.

Exchangeable component interfaces 125 may further comprise at least one interface releasable coupling means, such as shelves 126 illustrated in FIG. 3, which shelves 126 may be adapted to releasably couple with component releasable coupling means at the exchangeable components 102 and 152, such as the flexing clips 130 illustrated in FIG. 9. In some embodiments, interface releasable coupling means may comprise at least two shelves 126 positioned at opposing sides of the substantially rectangular groove 127, as illustrated in FIG. 7 and FIG. 3. The component releasable coupling means may comprise at least two flexing clip elements 130, positioned at opposing sides of the ridge 103, and adapted to flex in order to clip over at least two shelves 126. In some embodiments, an exchangeable component 102 may be released from an interchangeable base element 100, 150 by hand, by squeezing the flexing clip elements 130 while pulling the exchangeable component away from the interchangeable base element. In some embodiments, flexing clip elements 130 may comprise buttons 131 which may be flush with the body portion of exchangeable component 102, to allow squeezing the flexing clip elements 130 inward when the exchangeable component 102 is coupled with an exchangeable component interface 125.

The one or more exchangeable components 102, 152 may be adapted to securely and releasably couple with the exchangeable component interfaces 125 of the interchangeable base elements 101, 151. For example, the one or more exchangeable components 102, 152 may comprise a shape, such as a substantially rectangular shape of the ridge 103 on exchangeable component 102 as illustrated in FIG. 8. The ridge 103 or other shape may be adapted to match the shaped depressions 127 at the exchangeable component interfaces 125 of the interchangeable base elements 101, 151. The one or more exchangeable components 102, 152 may comprise component releasable coupling means 130 adapted to releasably couple with the interface releasable coupling means 126 at the interchangeable base elements 101, 151. As noted above, the one or more exchangeable components 102, 152 may include, for example, exchangeable foot pads, exchangeable wheels, and/or exchangeable handles.

FIG. 10 illustrates a luggage piece 1000 fitted with interchangeable luggage perimeters. In total, luggage piece 1000 has six faces, twelve edges, and eight corners. Luggage piece 1000 comprises four side faces, wherein side faces 1001 and 1002 are visible in FIG. 10. Luggage piece 1000 also comprises a top face 1006 and a bottom face (bottom face not visible in FIG. 10). A door for the luggage piece 100 is typically, though not necessarily, positioned at the top face 1006.

Interchangeable luggage perimeters 100, 150 may optionally be affixed by fasteners to any of the twelve edges of the luggage piece 1000. For example, corner element 100 may optionally be affixed at any of the eight corners of the luggage piece 1000. Mid-edge element 150 may optionally be affixed at any of the twelve edges of the luggage piece 1000.

In some embodiments, the edges and corners of luggage piece 1000 may not be identical. For example, the edges and corners adjoining the bottom face may be different from the edges and corners adjoining the top face 1006. In such scenarios, corner element 100 may be affixable, e.g., at any of the corners adjoining the top face 1006, or at any of the corners adjoining the bottom face, while corner element 100 may not be affixable at all eight corners of the luggage piece 1000. Thus corner element 100 may be affixable to any of, or each/all of, at least four corners of the luggage piece 1000. Stated another way, corner element 100 may be affixable to any of at least four edges of the luggage piece 1000, wherein the corner element 100 also extends to the end of an edge and around a proximal corner of the luggage piece 1000, as shown.

Similarly, when the edges and corners adjoining the bottom face are different from the edges and corners adjoining the top face 1006, mid-edge element 150 may be affixable, e.g., at any of the edges adjoining the top face 1006, or at any of the corners adjoining the bottom face, while mid-edge element 150 may not be affixable at all twelve edges of the luggage piece 1000. Thus mid-edge element 150 may be affixable to any of, or each/all of, at least four edges of the luggage piece 1000.

Asymmetric embodiments of interchangeable luggage perimeters 100, 150 are also contemplated herein. For example, in the case of corner element 100, the legs of a single given base element 101 may be sized or shaped differently from one another. As a result, the corners of luggage piece 1000 to which corner element 100 may be affixable may be constrained to a more limited subset of the corners of luggage piece 1000. For example, corner element 100 may be repositionable to at any of, or each/all of, at least two corners of luggage piece 1000. Stated differently, base element 101 may be repositionable at any of, or at each/all of, at least two edges of luggage piece 1000, wherein the base element 101 may extend to the end of an edge and around a proximal corner of the luggage piece 1000.

In an example asymmetric embodiment of mid-edge element 150, the right and left halves of a single given base element 151 may be sized or shaped differently from one another, thereby supporting repositioning of the interchangeable base element 151 at any of, or at each/all of, at least two edges of the luggage piece 1000.

While certain examples have been described herein, it should be understood by those skilled in the art that various other modifications may be made, and equivalents may be substituted. Therefore, the invention is not limited to the particular examples disclosed, but includes all implementations falling within the spirit and scope of this description.

The invention claimed is:

1. An interchangeable luggage perimeter, comprising:

an interchangeable base element comprising:

a base element outer surface and a base element inner surface, wherein the base element outer surface and the base element inner surface comprise parallel surfaces each having substantially a base element width and substantially a base element length, and wherein the base element outer surface and the base element inner surface are separated by a base element thickness;

wherein the base element width is less than the base element length, and wherein the base element thickness is less than half of the base element width;

at least two fastener openings perpendicular to the base element outer surface and the base element inner surface, wherein the at least two fastener openings are positioned at substantially opposite ends of the base element length, and wherein the interchangeable base element may be affixed by fasteners through the at least two fastener openings to at least one edge of a luggage piece; and an exchangeable component interface positioned between the at least two fastener openings and adapted to securely and releasably couple with exchangeable components, wherein the exchangeable component interface comprises:

a shaped depression in the base element outer surface, wherein the shaped depression has shape adapted to match an exchangeable component shape, and wherein the shaped depression comprises a substantially rectangular groove extending around a center island, wherein the center island is adapted to match a center depression in the one or more exchangeable components; and at least one interface releasable coupling means adapted to releasably couple with component releasable coupling means on the exchangeable components;

one or more exchangeable components adapted to securely and releasably couple with the exchangeable component interface of the interchangeable base element, wherein the one or more exchangeable components comprise:

a shape adapted to match the shaped depression at the interchangeable base element; and component releasable coupling means adapted to releasably couple with the interface releasable coupling means at the interchangeable base element.

2. The interchangeable luggage perimeter of claim 1, wherein the one or more exchangeable components comprise an exchangeable foot pad.

3. The interchangeable luggage perimeter of claim 1, wherein the interchangeable base element is symmetrical about a center axis parallel to the base element width at one half of the base element length, so that the interchangeable base element may be affixed by fasteners through the at least two fastener openings to any of at least four edges of the luggage piece.

4. The interchangeable luggage perimeter of claim 1, wherein the interchangeable luggage perimeter element comprises a corner element, and wherein:

the base element outer surface and the base element inner surface bend to form two legs extending perpendicularly from one another;

the at least two fastener openings are supplemented by at least one third fastener opening perpendicular to the base element outer surface and the base element inner surface, wherein the at least one third fastener opening is positioned substantially midway between the at least two fastener openings;

the interchangeable base element comprises a first exchangeable component interface positioned between the at least one third fastener opening and a first of the at least two fastener openings, and a second exchangeable component interface positioned between the at least one third fastener opening and a second of the at least two fastener openings; and when a first leg of the interchangeable base element is affixed to any of the at least four edges of the luggage piece, and a second leg of the interchangeable base element extends around a corner and along an adjacent edge of the luggage piece.

5. The interchangeable luggage perimeter of claim 4, wherein the corner element comprises a contoured corner bead protective lip extending from a single side of the corner element.

6. The interchangeable luggage perimeter of claim 1, wherein the at least one interface releasable coupling means comprises at least two shelves positioned at opposing sides of the substantially rectangular groove, and wherein the component releasable coupling means comprises at least two flexing clip elements adapted to flex in order to clip over at least two shelves.

* * * * *